US010998662B2

(12) United States Patent
Chen

(10) Patent No.: US 10,998,662 B2
(45) Date of Patent: May 4, 2021

(54) ELECTRICAL CONNECTOR

(71) Applicant: LOTES CO., LTD, Keelung (TW)

(72) Inventor: Chih Kun Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/838,092

(22) Filed: Apr. 2, 2020

(65) Prior Publication Data

US 2020/0328550 A1 Oct. 15, 2020

(30) Foreign Application Priority Data

Apr. 12, 2019 (CN) ..... 201910291885.8

(51) Int. Cl.
*H01R 13/24* (2006.01)
*H01R 24/64* (2011.01)
*H01R 107/00* (2006.01)

(52) U.S. Cl.
CPC ..... *H01R 13/2492* (2013.01); *H01R 24/64* (2013.01); *H01R 2107/00* (2013.01)

(58) Field of Classification Search
CPC ..... H01R 12/52; H01R 13/2435
USPC ..... 439/66
See application file for complete search history.

(56) References Cited

U.S. PATENT DOCUMENTS 4,161,346 A * 7/1979 Cherian ..... H01R 12/714 439/515
4,199,209 A * 4/1980 Cherian ..... H01R 23/722 439/515
4,362,353 A * 12/1982 Cobaugh ..... H05K 7/10 29/882
4,511,197 A * 4/1985 Grabbe ..... H05K 7/1069 439/329
4,647,124 A * 3/1987 Kandybowski ..... H05K 7/1069 439/515
4,655,519 A * 4/1987 Evans ..... H05K 7/1069 439/514
4,699,593 A * 10/1987 Grabbe ..... H05K 7/1069 439/71
4,906,194 A * 3/1990 Grabbe ..... H05K 7/1069 439/607.07

(Continued)

FOREIGN PATENT DOCUMENTS

CN 107093827 A 8/2017
CN 107565236 A 1/2018

*Primary Examiner* — Neil Abrams
(74) *Attorney, Agent, or Firm* — Locke Lord LLP; Tim Tingkang Xia, Esq.

(57) ABSTRACT

An electrical connector includes an insulating body provided with a accommodating hole, and a terminal and an electrical conductor accommodated in the accommodating hole and separately provided. The terminal includes a base provided in the corresponding accommodating hole, and two elastic arms respectively formed by bending and extending from the base. Each elastic arm extends to form a contact portion. Each contact portion extends to form an extending arm. Each extending arm has a first side edge, a second side edge and an end edge. Each first side edge has an abutting portion for abutting the corresponding electrical conductor. Each first side edge has a first guide portion extending between a corresponding contact portion and a corresponding abutting portion, and a second guide portion extending between the corresponding abutting portion and a corresponding end edge.

17 Claims, 11 Drawing Sheets

(56) References Cited

U.S. PATENT DOCUMENTS 4,995,817 A * 2/1991 Grabbe ..... H05K 7/103 29/874
5,092,783 A * 3/1992 Suarez ..... H01R 4/48 439/71
5,167,512 A * 12/1992 Walkup ..... H01R 13/2421 439/65
5,230,632 A * 7/1993 Baumberger ..... H01R 13/03 439/591
5,437,556 A * 8/1995 Bargain ..... H01R 13/2435 439/66
5,653,598 A * 8/1997 Grabbe ..... H01R 13/2435 439/66
5,655,913 A * 8/1997 Castaneda ..... H01R 12/57 439/66
5,984,693 A * 11/1999 McHugh ..... H05K 7/1069 439/515
6,019,611 A * 2/2000 McHugh ..... H01R 13/2435 439/515
6,227,869 B1 * 5/2001 Lin ..... H05K 7/1069 439/515
6,293,806 B1 * 9/2001 Yu ..... H01R 13/2442 439/66
6,957,964 B2 * 10/2005 Chiang ..... H01R 13/2435 439/66
7,445,461 B1 * 11/2008 Polnyi ..... H01R 13/2407 439/66
8,888,502 B2 * 11/2014 Terhune, IV ..... H01R 12/7076 439/66
8,926,379 B2 * 1/2015 Vinther ..... H01R 4/48 439/817
9,088,083 B2 * 7/2015 Mason ..... H01R 13/2421
10,135,199 B1 * 11/2018 Ju ..... H01R 12/714
10,148,024 B2 * 12/2018 Ju ..... H05K 3/3436
10,707,606 B2 * 7/2020 Ho ..... H01R 12/57
2020/0328550 A1 * 10/2020 Chen ..... H01R 12/714

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910291885.8 filed in China on Apr. 12, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector that transmits high-frequency signals and has a conductive terminal with multiple conductive paths.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector includes an insulating body and multiple terminals and multiple electrical conductors accommodated in the insulating body. The terminals and the electrical conductors are separated and arranged in pairs, and each electrical conductor is located at the front left side or the front right side of the corresponding terminal. The terminals are made of a metal plate. Each of the terminals includes a base. A first elastic arm is formed by bending and extending upward from the base, and is used to upward abut a chip module. A second elastic arm is formed by extending downward from the base, and is used to downward abut a circuit board. One side edge of each of the free ends of the first elastic arm and the second elastic arm is provided with a guide chamfer. When the chip module and the circuit board respectively abut against the first elastic arm and the second elastic arm, the guide chamfers function to guide the first elastic arm and the second elastic arm, such that the terminal and the electrical conductor laterally abut each other.

However, to ensure stable contact between the terminals and the electrical conductors, and to enable the guide chamfers of the terminals to guide the electrical conductors in the mounting process of the electrical conductors, a distance between the elastic arm and the corresponding electrical conductor is too short. Thus, whether the electrical conductors are firstly mounted to the insulating body and the terminals are then mounted to the insulating body, or the terminals are firstly mounted to the insulating body and the electrical conductors are then mounted to the insulating body, the elastic arm and the corresponding electrical conductor are likely to abut each other in the vertical direction, thereby hindering the mounting of the ones of the terminals and the electrical conductors being mounted later into the insulating body, and even causing damage to the terminals and the electrical conductors, which is not conducive to the entire mounting process.

Therefore, a heretofore unaddressed need to design an improved electrical connector exists in the art to address the aforementioned deficiencies and inadequacies.

SUMMARY

In view of the deficiencies in the background, the present invention is directed to an electrical connector that facilitates sequential mounting of a terminal and an electrical conductor and is provided with multiple stable conductive paths.

To achieve the foregoing objective, the present invention adopts the following technical solutions.

An electrical connector is configured to electrically connect a mating assembly to a matching assembly. The electrical connector includes: an insulating body, provided with at least one accommodating hole; at least one electrical conductor, correspondingly mounted to the at least one accommodating hole; and at least one terminal, correspondingly mounted to the at least one accommodating hole, wherein the electrical conductor and the terminal mounted to a same one of the at least one accommodating hole are separately provided, and each of the at least one terminal comprises: a base, provided in a corresponding accommodating hole of the at least one accommodating hole; two elastic arms, respectively formed by bending and extending from the base; two contact portions, wherein each of the contact portions is correspondingly formed by extending from one of the two elastic arms, one of the two contact portions is exposed upward to the corresponding accommodating hole to be in contact with the mating assembly, and the other of the two contact portions is exposed downward to the corresponding accommodating hole to be in contact with the matching assembly; two extending arms, formed by respectively and correspondingly extending from the contact portions, wherein each of the extending arms has a first side edge and a second side edge opposite to each other in a left-right direction and an end edge connecting the first side edge and the second side edge; two abutting portions, respectively and correspondingly provided at the first side edges of the two extending arms, and configured to abut the corresponding electrical conductor, wherein the two abutting portions are located between the two contact portions in a vertical direction, and each of the abutting portions is respectively provided to be away from the second side edge of a corresponding extending arm of the extending arms in the left-right direction relative to a corresponding contact portion of the contact portions and the end edge of the corresponding extending arm; two first guide portions, respectively and correspondingly provided at the first side edges of the two extending arms, wherein each of the two first guide portions extends between the corresponding contact portion and a corresponding abutting portion of the abutting portions; and two second guide portions, respectively and correspondingly provided at the first side edges of the two extending arms, wherein each of the two first guide portions extends between the corresponding abutting portion and the end edge of the corresponding extending arm.

In certain embodiments, the two abutting portions and the corresponding electrical conductor are located in front of the base.

In certain embodiments, the two abutting portions are aligned in the vertical direction.

In certain embodiments, each of the extending arms has a width gradually increasing at a portion from the corresponding contact portion to the corresponding abutting portion in the left-right direction, and a width gradually decreasing at a portion from the corresponding abutting portion to the end edge of the corresponding extending arm in the left-right direction.

In certain embodiments, each of the first guide portions is an arc-shaped structure.

In certain embodiments, each of the second guide portions is an inclined plane structure.

In certain embodiments, the electrical conductor has one side close to the terminal, an upper end and a lower end of the one side of the electrical conductor are respectively provided with two oblique portions respectively provided corresponding to the two abutting portions, and when the mating assembly and the matching assembly respectively and correspondingly abut the contact portions, the second guide portions are correspondingly guided by the oblique portions.

In certain embodiments, each of the second guide portions and a corresponding oblique portion of the oblique portions have a same inclination angle.

In certain embodiments, the terminal and the corresponding electrical conductor are sequentially mounted to the corresponding accommodating hole along a same direction.

In certain embodiments, the terminal and the corresponding electrical conductor are mounted to the corresponding accommodating hole along opposite directions.

In certain embodiments, the electrical conductor is located between the two contact portions of the corresponding terminal in the vertical direction.

In certain embodiments, when the terminal and the electrical conductor are sequentially mounted into the accommodating hole, the electrical conductor and one of the first guide portions of the terminal guide each other.

In certain embodiments, the second side edge of each of the extending arms is a vertical plain surface.

In certain embodiments, the accommodating hole has two side walls in the left-right direction and a front wall and a rear wall in a front-rear direction, a protruding block is formed by protruding from one of the side walls, and the protruding block matches with the front wall to fix the electrical conductor.

In certain embodiments, the insulating body is provided with an upper surface, one of the contact portions of the terminal in contact with the mating assembly protrudes out of the upper surface, a projecting portion protrudes upward from the upper surface at a lateral side of each of the at least one electrical conductor, and the electrical conductor is provided not to be higher than the corresponding projecting portion in the vertical direction.

In certain embodiments, the two elastic arms of the terminal are provided to be vertically symmetrical with respect to the base.

In certain embodiments, the end edge of each of the extending arms is an arc-shaped structure.

Compared with the related art, the terminal has the two elastic arms formed by bending and extending from the base. Each of the elastic arms extends to form the contact portion, and the contact portion extends to form the extending arm. Each of the extending arms is provided with the first guide portion, the second guide portion and the abutting portion. The first guide portions are provided to facilitate the sequential mounting of the electrical conductor and the terminal. The second guide portions are provided to allow the extending arms to guide the electrical conductor when the contact portions are applied with the force, such that the abutting portions abut the electrical conductor. Moreover, the terminal has multiple electrical paths from the mating assembly to the matching assembly, which can satisfy the high frequency requirements of the terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
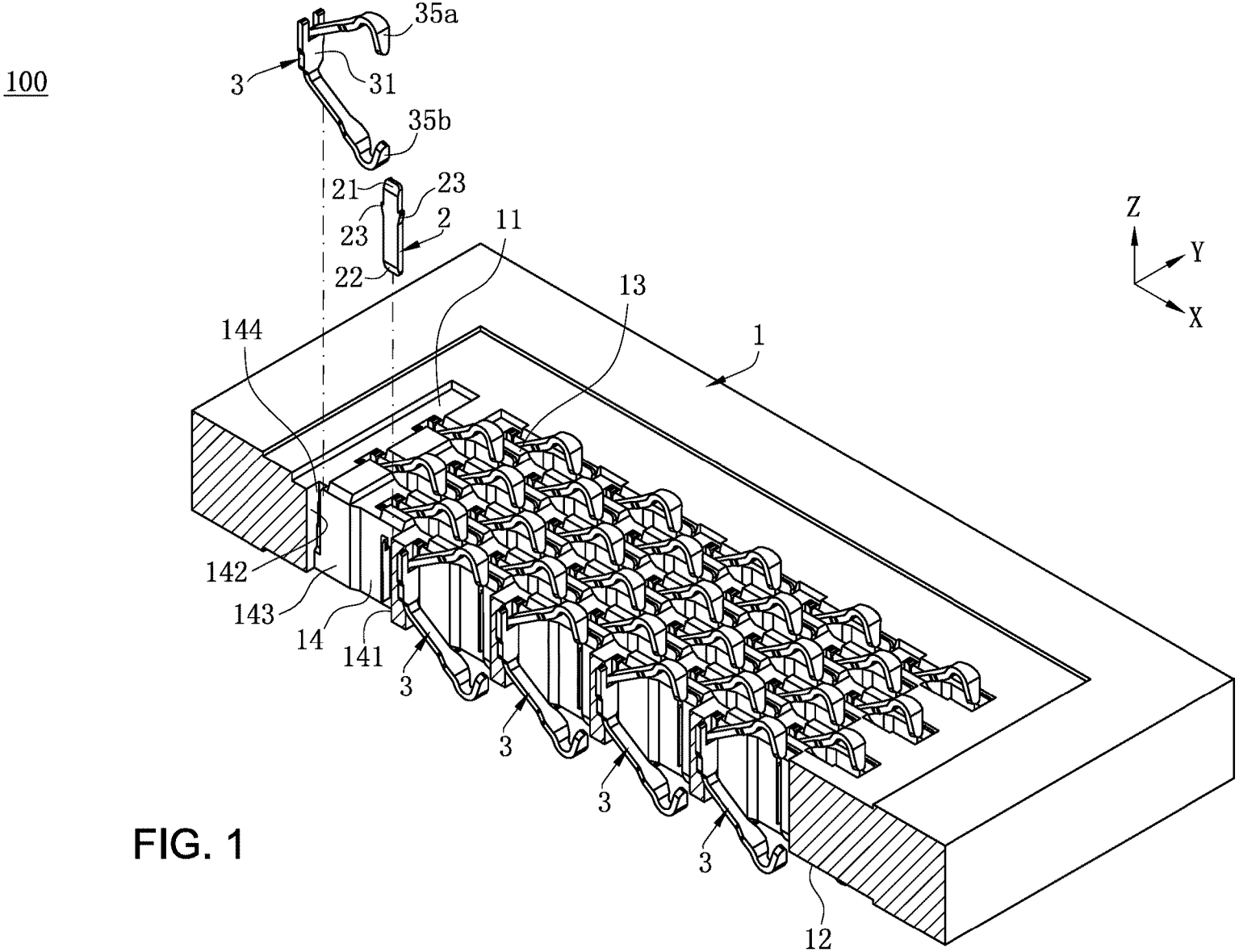
FIG. 1 is a perspective view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector and an assembly method thereof.

Figure 6:
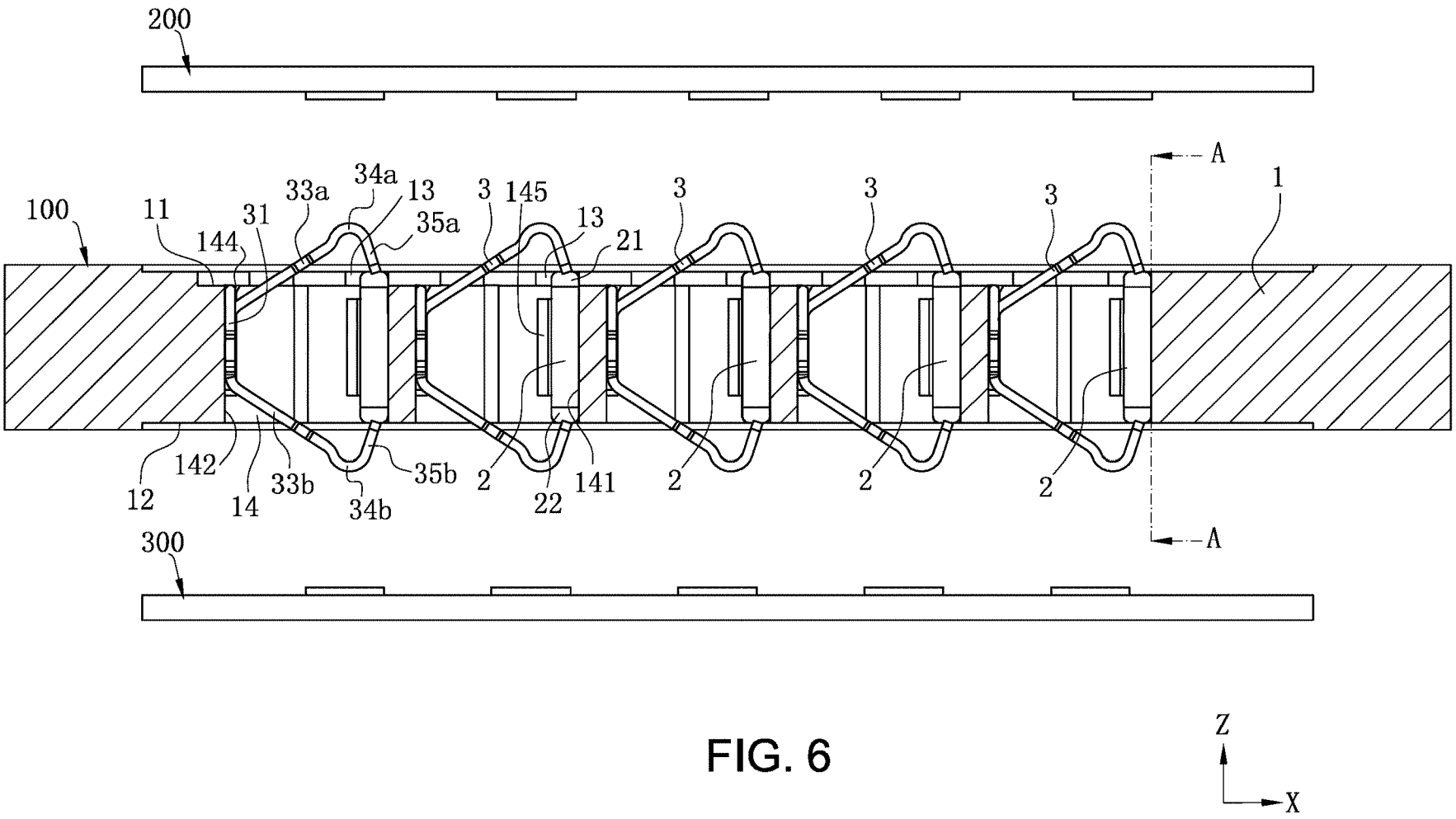
FIG. 6 is a front view of the electrical connector in FIG. 1 when the electrical connector is not mated with a mating assembly or a matching assembly.
Figure 9:
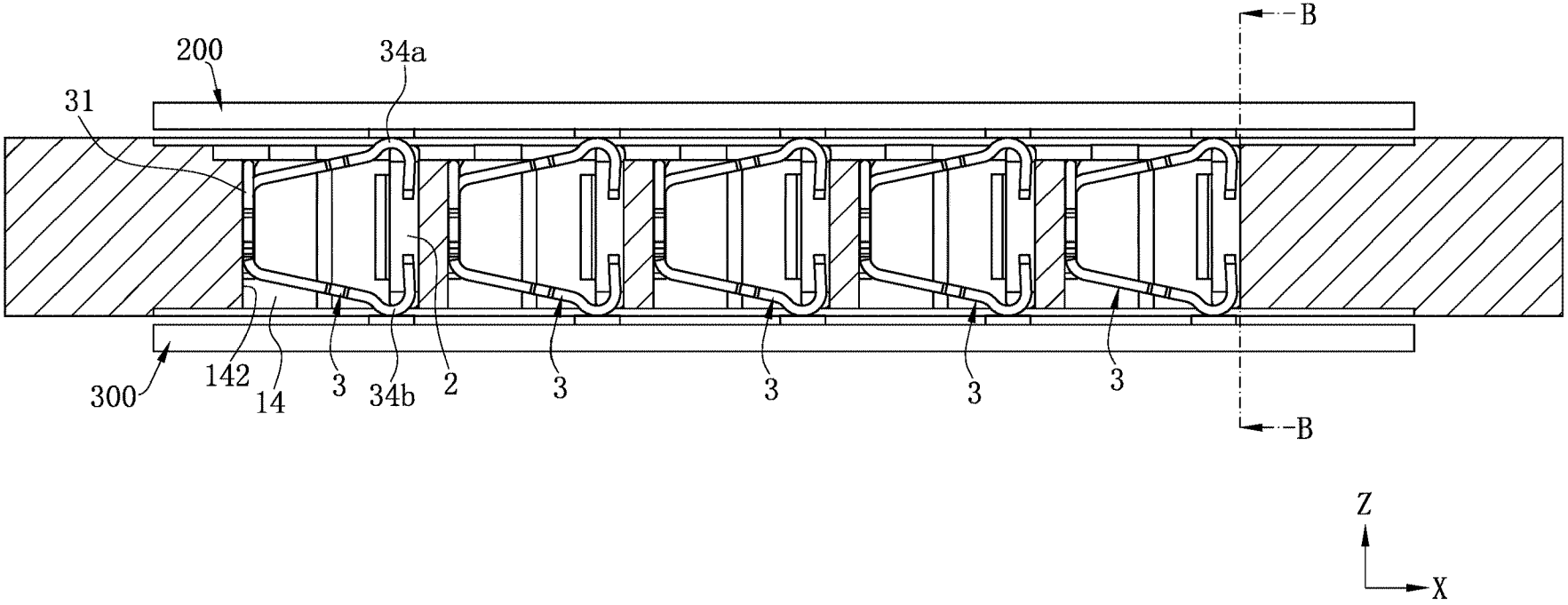
FIG. 9 is a schematic view of the electrical connector in FIG. 6 when the electrical connector is mated with the mating assembly and the matching assembly.
Figure 10:
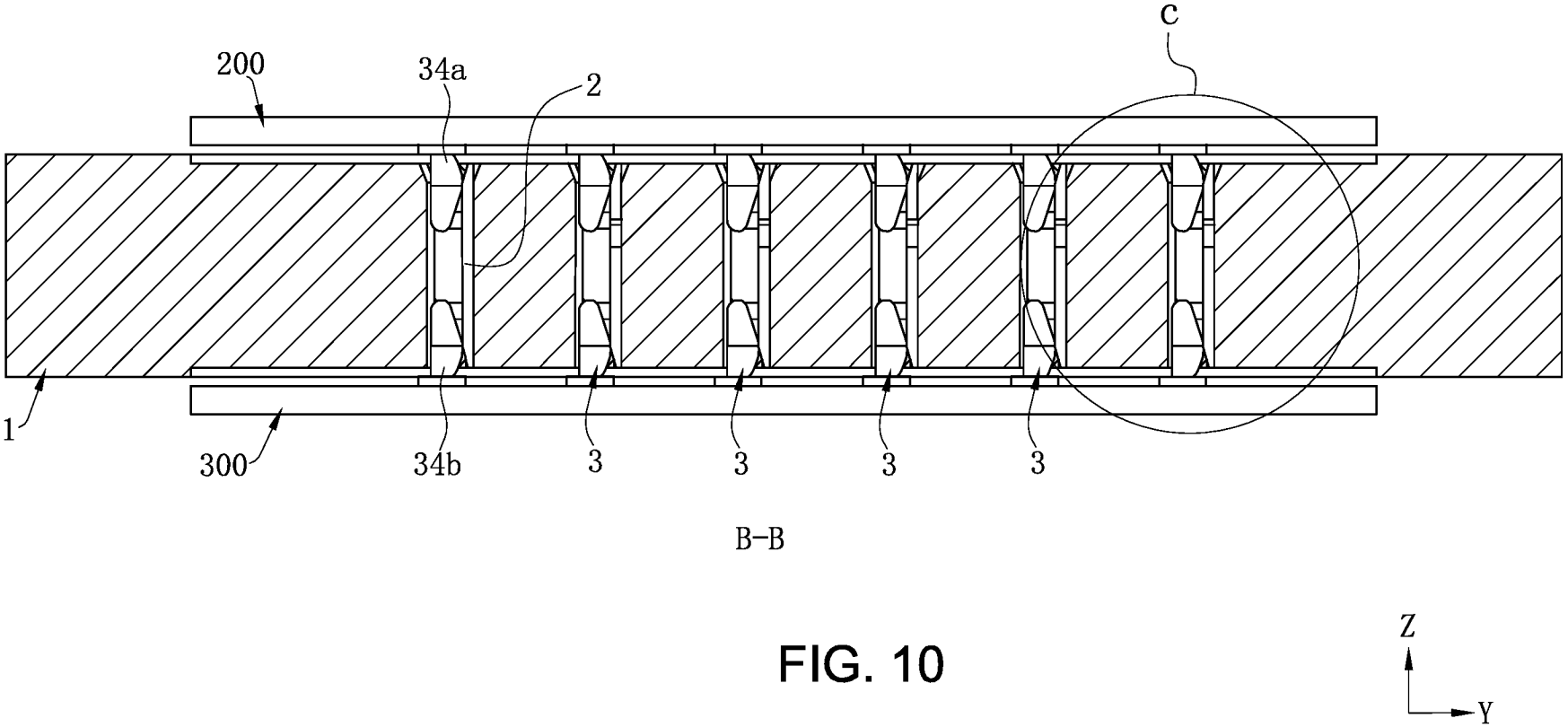
FIG. 10 is a sectional view of FIG. 9 along a line B-B.

FIG. 1, FIG. 6 and FIG. 9 show an electrical connector 100 according to certain embodiments of the present invention. The electrical connector 100 is used to electrically connect a mating assembly 200 to a matching assembly 300. In this embodiment, the mating assembly 200 is a chip module, and the matching assembly 300 is a circuit board. In other embodiments, other components may be used. For example, the mating assembly 200 and the matching assembly 300 can be both circuit boards. The types of the mating assembly 200 and the matching assembly 300 are not limited thereto, as long as the mating assembly 200 and the matching assembly 300 match with the electrical connector 100.

As shown in FIG. 1, the electrical connector 100 defines a front-rear direction X, a left-right direction Y and a vertical direction Z. The front-rear direction X, the left-right direction Y and the vertical direction Z are perpendicular to one another.

As shown in FIG. 1, FIG. 6 and FIG. 9, the electrical connector 100 includes an insulating body 1, and multiple electrical conductors 2 and multiple terminals 3 provided in the insulating body 1. One end of each of the terminals 3 elastically abuts the mating assembly 200, and the other end elastically abuts the matching assembly 300.

Figure 2:
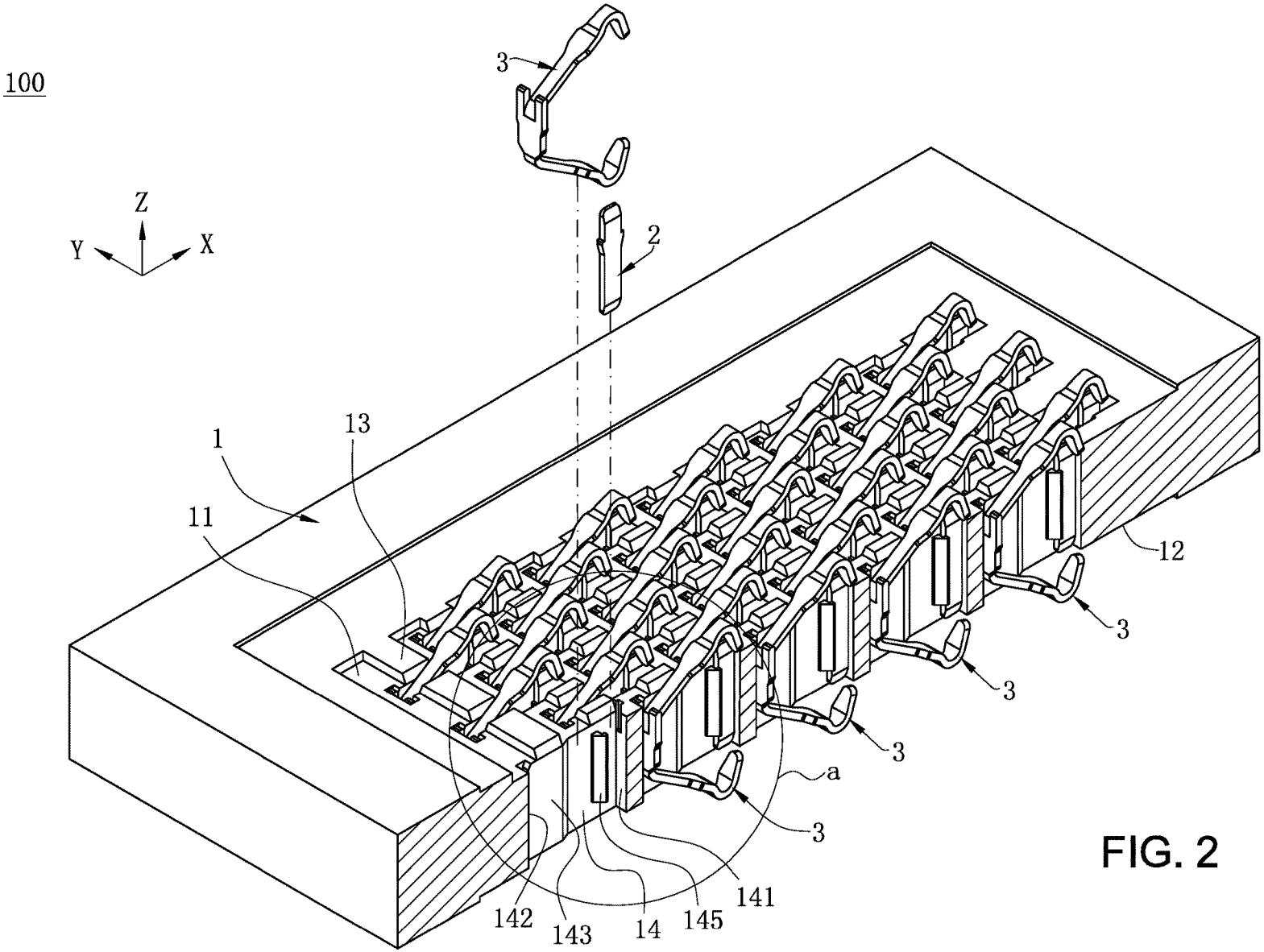
FIG. 2 is a perspective view of the electrical connector in FIG. 1 being rotated ninety degrees counterclockwise horizontally.
Figure 3:
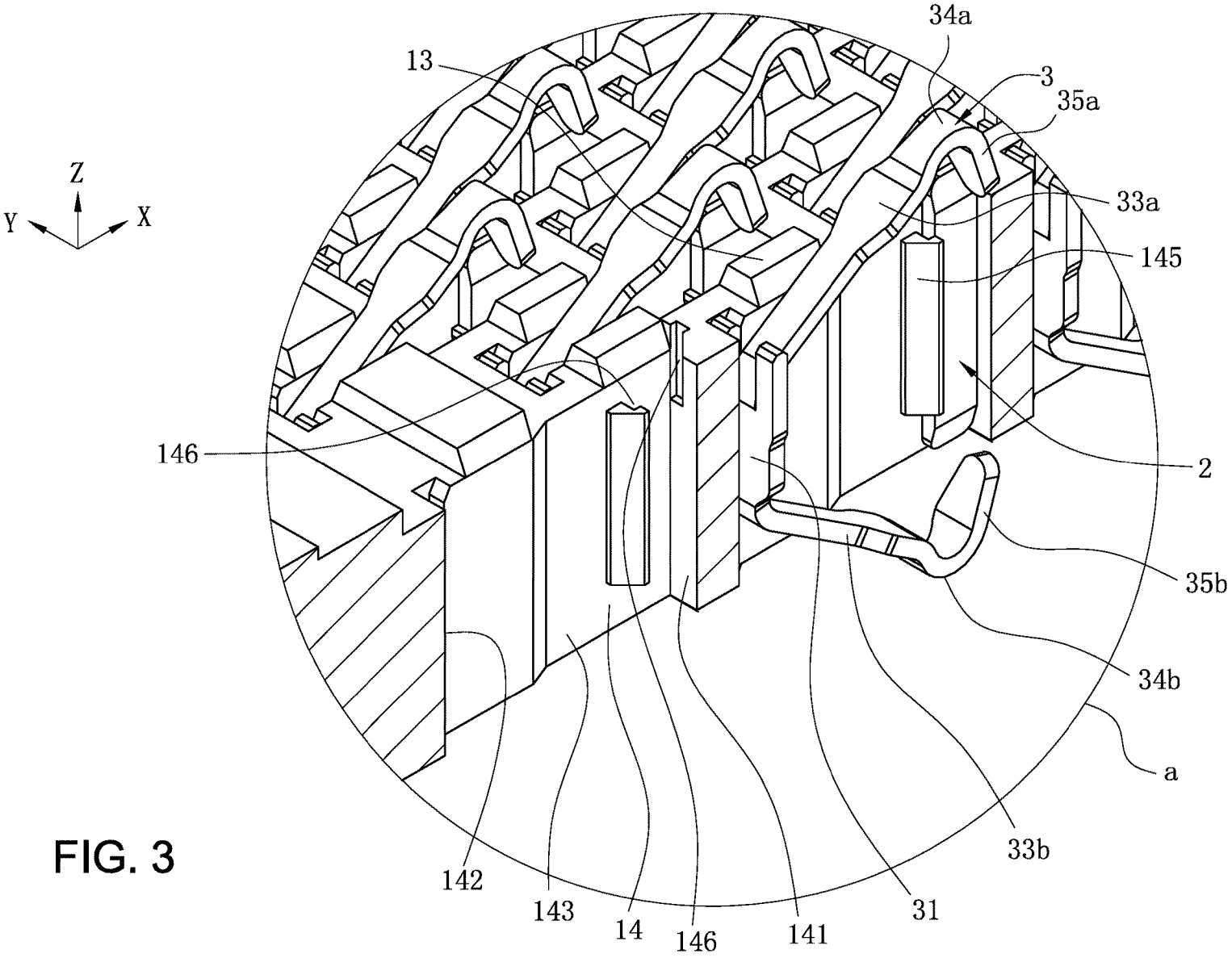
FIG. 3 is a partial enlarged view of a portion a in FIG. 2.

As shown in FIG. 2 and FIG. 3, the insulating body 1 has an upper surface 11 and a lower surface 12 provided opposite to each other. Multiple projecting portions 13 are protrudingly provided upward from the upper surface 11. The insulating body 1 further has multiple accommodating holes 14 running through the upper surface 11 and the lower surface 12. The accommodating holes 14 are arranged in a matrix, and are arranged in multiple columns in the left-right direction Y. Each column has multiple accommodating holes 14 arranged in the front-rear direction X. Multiple accommodating holes 14 in two adjacent columns are provided staggeredly in the front-rear direction X.

As shown in FIG. 1 to FIG. 3, a lateral side of each of the accommodating holes 14 is correspondingly provided with one projecting portion 13. Each of the accommodating holes 14 includes a front wall 141 and a rear wall 142 opposite to each other in the front-rear direction X, and two side walls 143 connecting the front wall 141 and the rear wall 142. Each of the side walls 143 is depressed at a position close to the rear wall 142 to form a groove 144. The groove 144 runs upward through the upper surface 11, and does not run downward through the lower surface 12. One of the side walls 143 protrudes at a position close to the front wall 141 to form a protruding block 145, and the protruding block 145 and the front wall 141 are respectively depressed inward at positions close to the corresponding side wall 143 to form a position limiting slot 146. The position limiting slot 146 runs upward through the upper surface 11.

As shown in FIG. 2, FIG. 3 and FIG. 6, the electrical conductors 2 are correspondingly accommodated in the accommodating holes 14. Each electrical conductor 2 is fixed between the protruding block 145 and the front wall 141 in the corresponding accommodating hole 14, and each electrical conductor 2 is provided not to be higher than the corresponding projecting portion 13 in the vertical direction Z, and not to be lower than the lower surface 12. In this embodiment, each projecting portion 13 is located at the left side of the corresponding electrical conductor 2, and each projecting portion 13 and the corresponding electrical conductor 2 are provided to align each other in the left-right direction Y.

Figure 5:
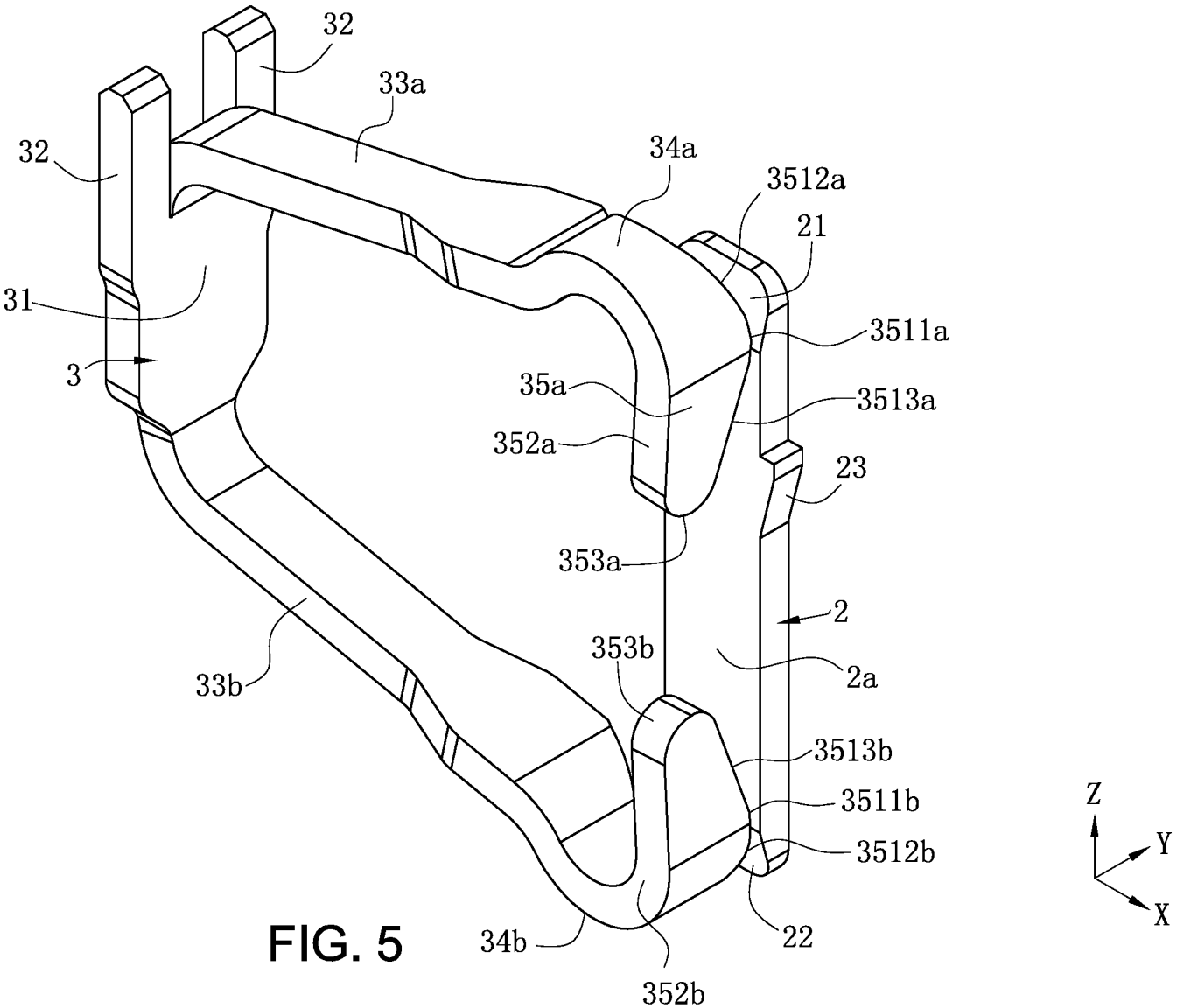
FIG. 5 is a perspective view of the terminal and an electrical conductor in a compressed state of FIG. 1.
Figure 8:
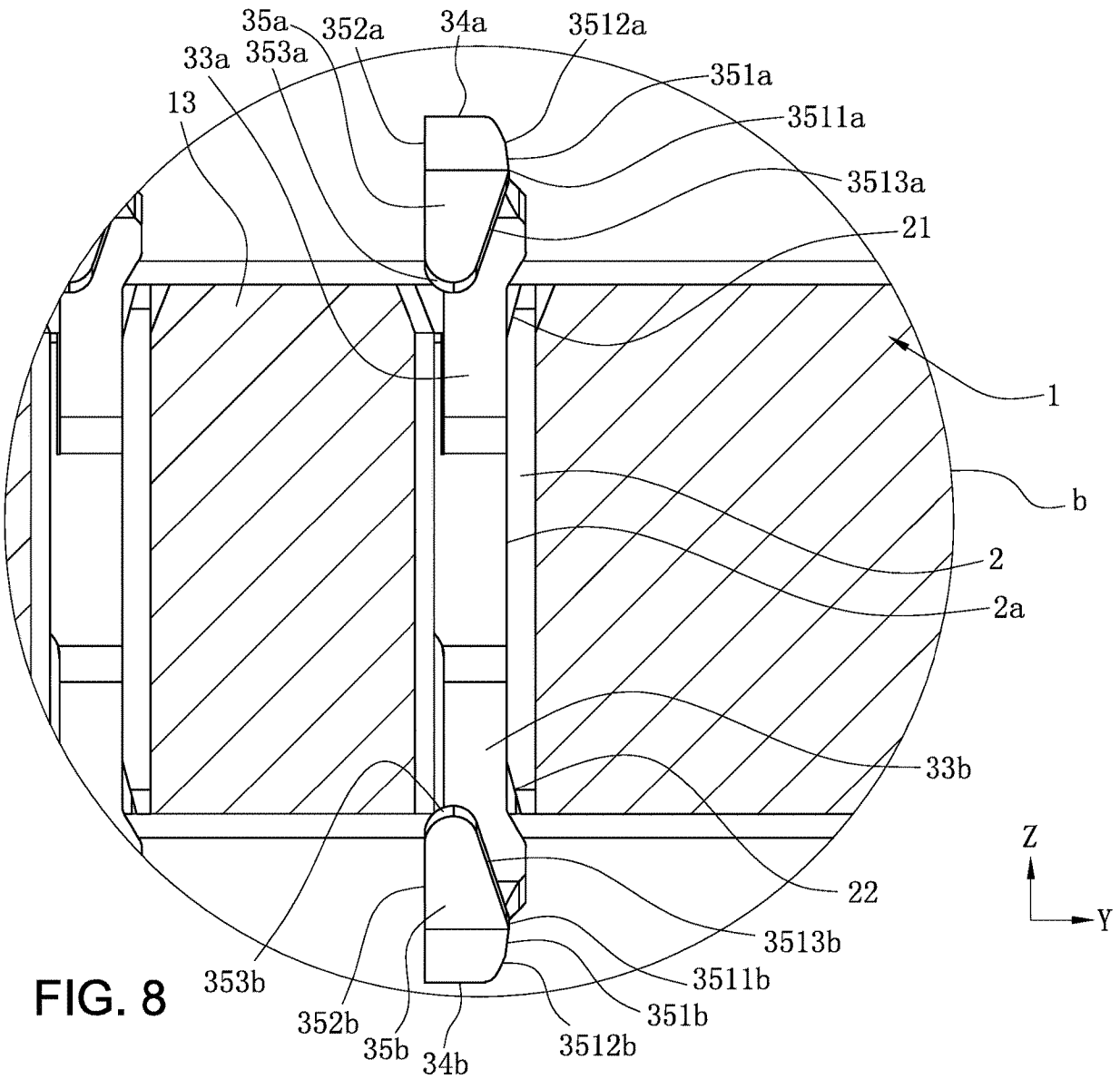
FIG. 8 is a partial enlarged view of a portion b in FIG. 7.

As shown in FIG. 1, FIG. 5 and FIG. 8, the upper and lower ends of the electrical conductor 2 are respectively provided with two oblique portions. The oblique portions are provided on a side 2*a* of the electrical conductor 2 facing the corresponding terminal 3. The oblique portion at the upper end of the electrical conductor 2 is defined as an upper oblique portion 21, and the oblique portion at the lower end of the electrical conductor 2 is defined as a lower oblique portion 22. In this embodiment, the upper oblique portion 21 and the lower oblique portion 22 are respectively a plain surface provided obliquely. That is, each of the upper and lower ends of the electrical conductor 2 has a wedge shape.

As shown in FIG. 1, FIG. 3 and FIG. 5, the front and rear sides of the electrical conductor 2 are respectively provided with two position limiting portions 23 protruding outward, and the position limiting portions 23 are located between the upper oblique portion 21 and the lower oblique portion 22 in the vertical direction Z. In this embodiment, the position limiting portions 23 are provided close to the upper oblique portion 21, and the position limiting portions 23 form an interference fit with the corresponding position limiting slots 146, such that the electrical conductor 2 is stably retained to the insulating body 1. Further, the position limiting portions 23 are simultaneously stopped by the position limiting slots 146, thereby preventing the electrical conductor 2 from moving downward.

As shown in FIG. 1 and FIG. 6, the terminals 3 are correspondingly accommodated in the accommodating holes 14. Each of the terminals 3 has a base 31 accommodated in the corresponding accommodating hole 14. The base 31 abuts the rear wall 142, and the left and right sides of the base 31 are respectively accommodated in the corresponding grooves 144, thereby preventing the terminal 3 from moving downward excessively.

Figure 4:
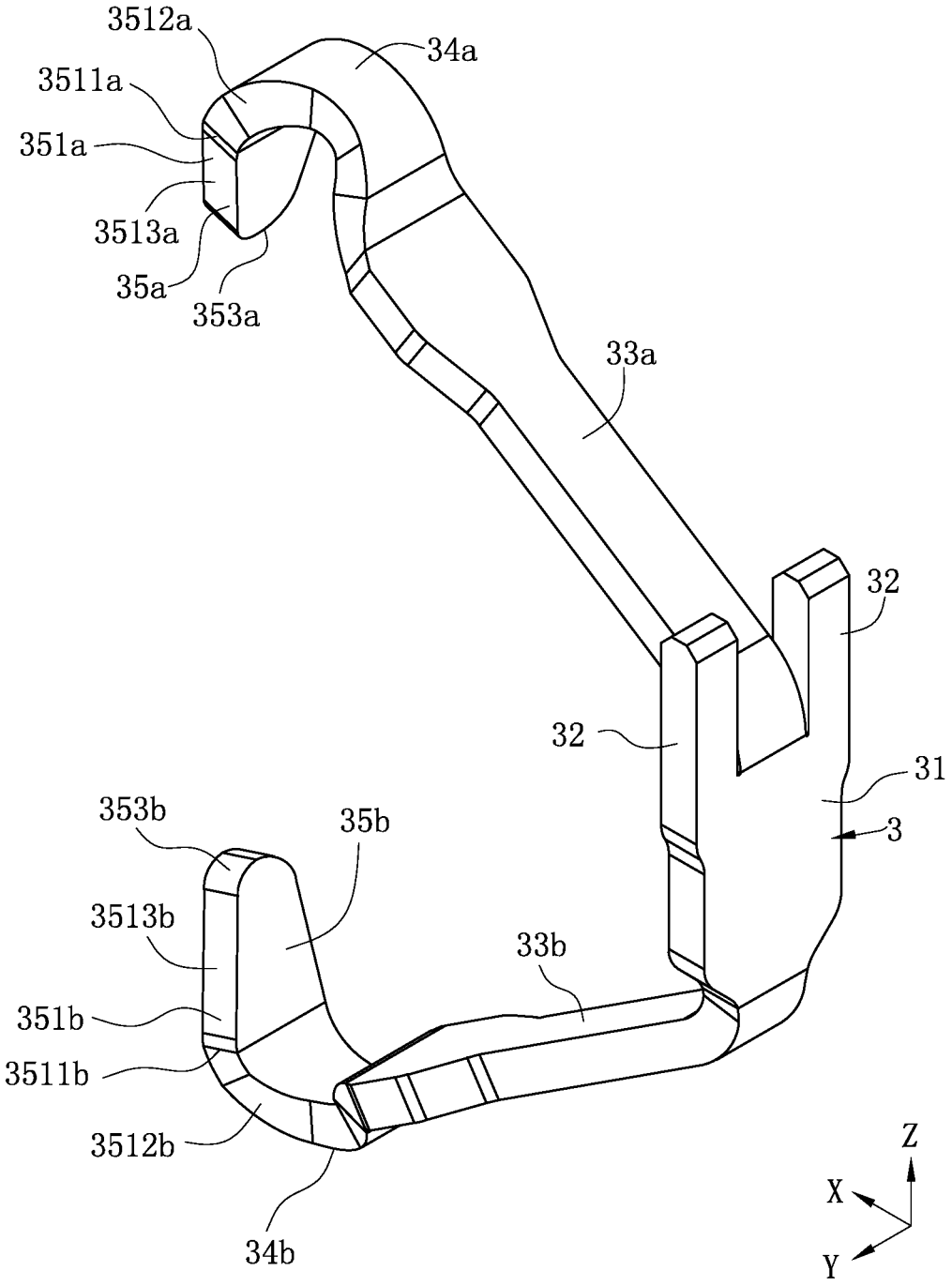
FIG. 4 is a perspective view of a terminal in FIG. 1 from another viewing angle.

As shown in FIG. 4 and FIG. 9, the top end of the base 31 is provided with two strip connecting portions 32 symmetrically to be connected with a strip (not shown). Two elastic arms are formed by bending and extending respectively from a top end and a bottom end of the base 31. Each of the elastic arms extends to form a contact portion, and each of the contact portions extends to form an extending arm. The elastic arm formed by bending upward and forward from the top end of the base 31 at a position between the two strip connecting portions 32 is defined as a first elastic arm 33*a*. The contact portion formed by extending from the first elastic arm 33*a* is defined as a first contact portion 34*a*. The first contact portion 34*a* is exposed upward to the corresponding accommodating hole 14 to abut the mating assembly 200, and the first contact portion 34*a* bends and extends forward to form a first extending arm 35*a*. The elastic arm formed by bending downward and forward from the bottom end of the base 31 is defined as a second elastic arm 33*b*. The first elastic arm 33*a* and the second elastic arm 33*b* are vertically symmetrical with respect to the base 31. The contact portion formed by extending from the second elastic arm 33*b* is defined as a second contact portion 34*b*. The second contact portion 34*b* is exposed downward to the corresponding accommodating hole 14 to abut the matching assembly 300, and the second contact portion 34*b* bends and extends forward to form a second extending arm 35*b*.

As shown in FIG. 4, FIG. 5 and FIG. 8, each of the first extending arm 35*a* and the second extending arm 35*b* is respectively provided with two side edges opposite to each other in the left-right direction Y, and an end edge connecting the two side edges. The two side edges of the first extending arm 35*a* are defined as a first side edge 351*a* and a second side edge 352*a*, and the end edge of the first extending arm 35*a* is defined as an upper end edge 353*a*. The two side edges of the second extending arm 35*b* are defined as a first side edge 351*b* and a second side edge 352*b*, and the end edge of the second extending arm 35*b* is defined as a lower end edge 353*b*. In this embodiment, the first side edge 351*a* is located at the left side of the first extending arm 35*a*, the second side edge 352*a* is located at the right side of the first extending arm 35*a*, the first side edge 351*b* is located at the left side of the second extending arm 35*b*, and the second side edge 352*b* is located at the right side of the second extending arm 35*b*. Each of the second side edges 352*a*, 352*b* is a vertical plain surface, and both are located on a same vertical plane. Each of the upper end edge 353*a* and the lower end edge 353*b* is an arc-shaped structure.

As shown in FIG. 4 and FIG. 8, each of the first side edges 351*a*, 351*b* is provided with an abutting portion to abut the electrical conductor 2. The abutting portion on the first side edge 351*a* is defined as a first abutting portion 3511*a*, and the abutting portion on the second side edge 351*b* is defined as a second abutting portion 3511*b*. The second abutting portion 3511*b* and the first abutting portion 3511*a* are aligned in the vertical direction Z.

As shown in FIG. 5 and FIG. 8, the first abutting portion 3511*a* is provided away from the second side edge 352*a* in the left-right direction Y relative to the corresponding first contact portion 34*a* and the upper end edge 353*a*. The first extending arm 35*a* has a width gradually increasing at a portion from the corresponding first contact portion 34*a* to the first abutting portion 3511*a* in the left-right direction Y, and a width gradually decreasing at a portion from the corresponding first abutting portion 3511*a* to the upper end edge 353*a* in the left-right direction Y. The first side edge 351*a* is provided with a first guide portion 3512*a* extending between the corresponding first contact portion 34*a* and the first abutting portion 3511*a*, and the first guide portion 3512*a* is an arc-shaped structure. The first side edge 351*a* is provided with a second guide portion 3513*a* extending between the corresponding first abutting portion 3511*a* and the upper end edge 353*a*. The second guide portion 3513*a* is an inclined plane structure, and the second guide portion 3513*a* and the corresponding upper oblique portion 21 have a same inclination angle.

As shown in FIG. 5 and FIG. 8, the second abutting portion 3511*b* is provided away from the second side edge 352*b* in the left-right direction Y relative to the corresponding second contact portion 34*b* and the lower end edge 353*b*. The second extending arm 35*b* has a width gradually increasing at a portion from the corresponding second contact portion 34*b* to the second abutting portion 3511*b* in the left-right direction Y, and the second extending arm 35*b* has a width gradually decreasing at a portion from the corresponding second abutting portion 3511*b* to the lower end edge 353*b* in the left-right direction Y. The first side edge 351*b* is provided with a first guide portion 3512*b* extending between the corresponding second contact portion 34*b* and the second abutting portion 3511*b*, and the first guide portion 3512*b* is an arc-shaped structure. The first side edge 351*b* is provided with a second guide portion 3513*b* extending between the corresponding second abutting portion 3511*b* and the lower end edge 353*b*. The second guide portion 3513*b* is an inclined plane structure, and the second guide portion 3513*b* and the corresponding lower oblique portion 22 have the same inclination angle.

As shown in FIG. 5 and FIG. 6, in the embodiment of the present invention, after the terminal 3 is firstly mounted into the corresponding accommodating hole 14 downward from top thereof, the electrical conductor 2 is then mounted into the accommodating hole 14 downward from top thereof. During the mounting of the electrical conductor 2, the electrical conductor 2 is guided by the first guide portion 3512*a* of the first extending arm 35*a* to facilitate the mounting of the electrical conductor 2 into the accommodating hole 14. At this time, the first abutting portion 3511*a*, the second abutting portion 3511*b* and the corresponding electrical conductor 2 are located in front of the base 31, and the electrical conductor 2 is located between the first contact portion 34*a* and the second contact portion 34*b* in the vertical direction Z.

Figure 7:
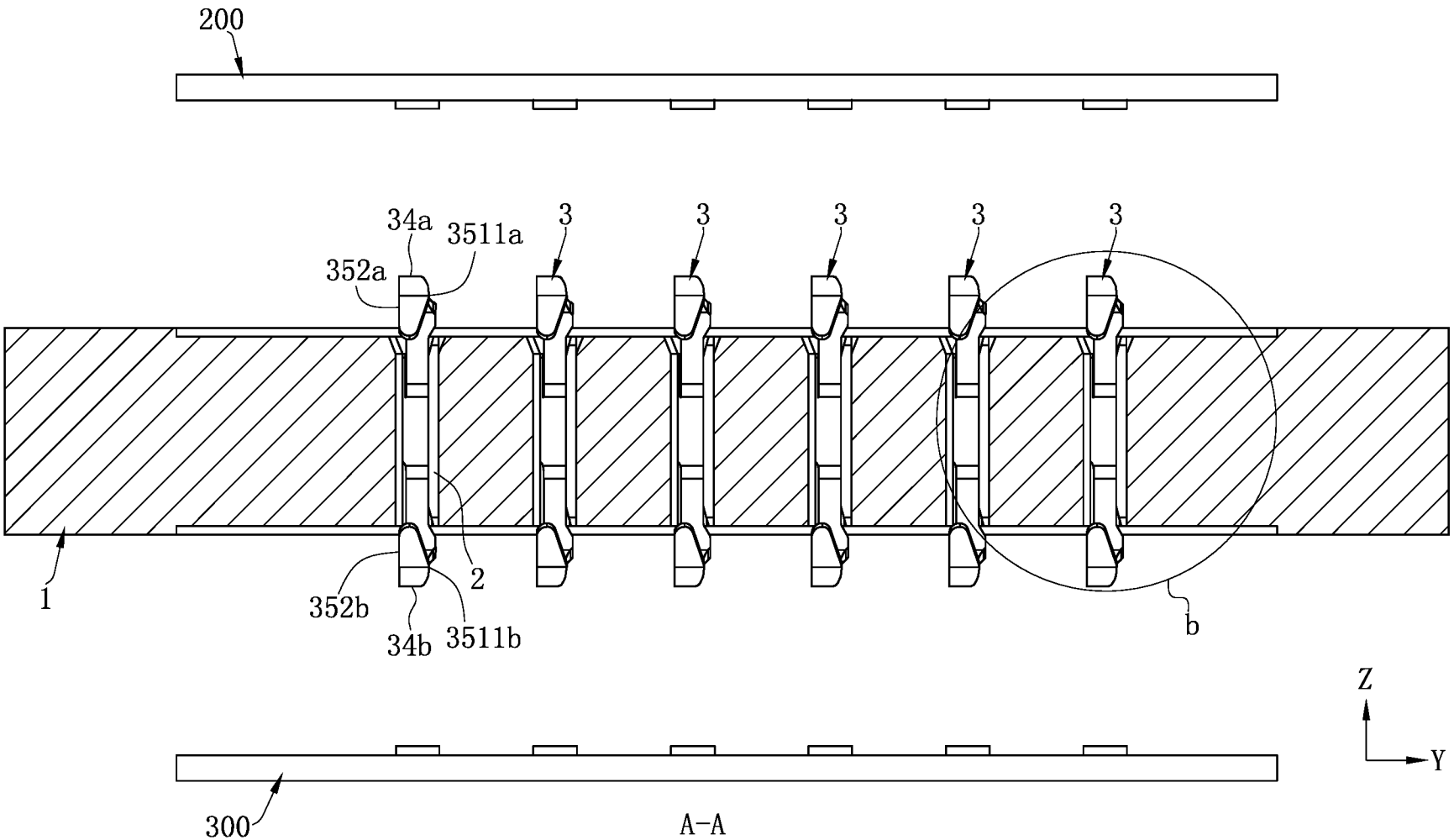
FIG. 7 is a sectional view of FIG. 6 along a line A-A.
Figure 11:
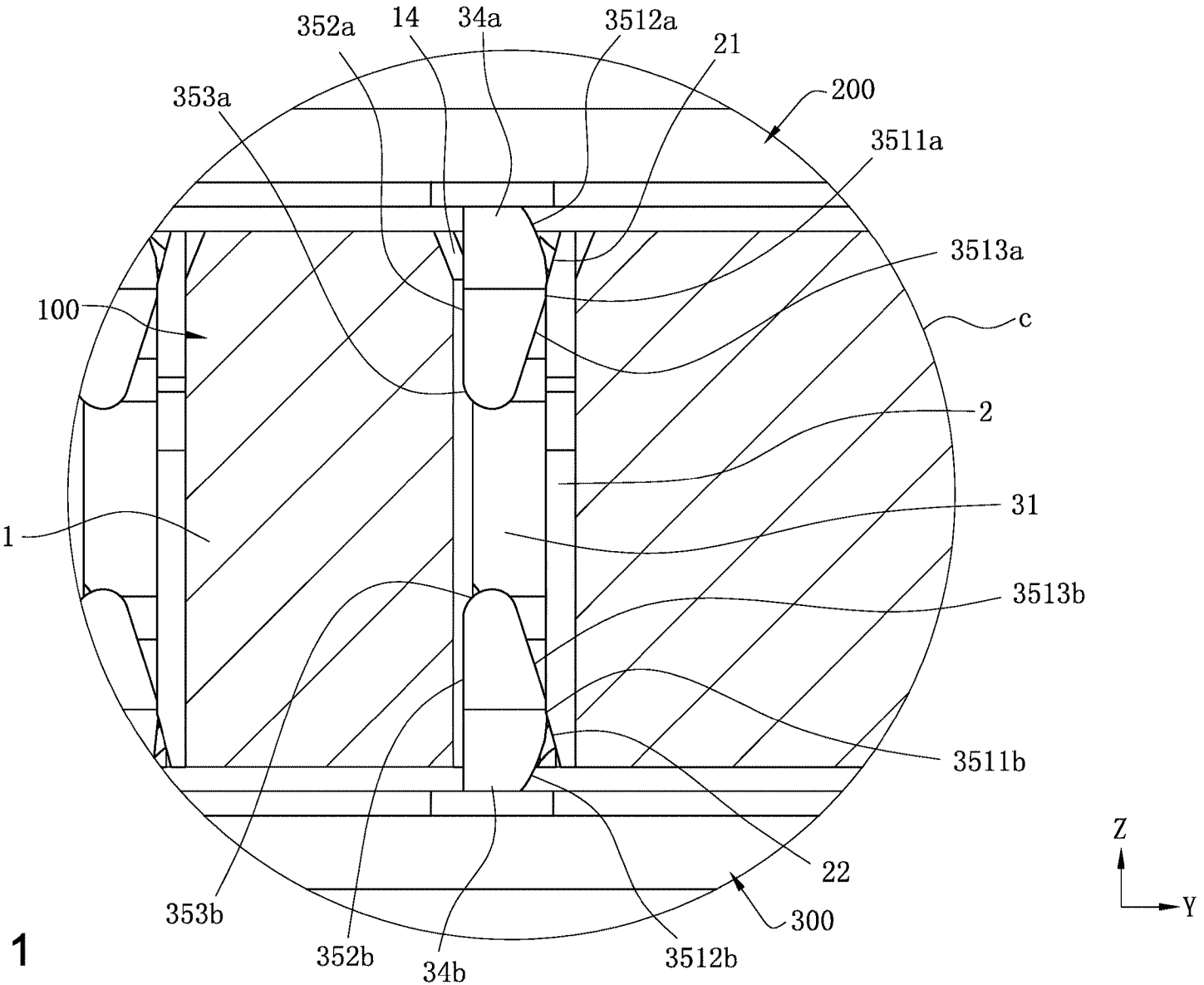
FIG. 11 is a partial enlarged view of a portion c in FIG. 10.

As shown in FIG. 7 and FIG. 11, the mating assembly 200 presses on the first contact portion 34*a*. When the matching assembly 300 is in contact with the corresponding second contact portion 34*b*, the first elastic arm 33*a* is elastically deformed under the force, such that the first contact portion 34*a* moves downward relative to the insulating body 1. The second guide portion 3513*a* of the first extending arm 35*a* slides downward along the upper oblique portion 21, such that the first abutting portion 3511*a* stably abuts the electrical conductor 2. The second elastic arm 33*b* is elastically deformed under the force, such that the first contact portion 34*a* moves upward relative to the insulating body 1. The second guide portion 3513*b* of the second extending arm 35*b* slides upward along the lower oblique portion 22, such that the second abutting portion 3511*b* stably abuts the electrical conductor 2. Finally, the first abutting portion 3511*a* and the second abutting portion 3511*b* stably abut the corresponding electrical conductor 2. At this time, a first conductive path is formed via the mating assembly 200, the first contact portion 34*a*, the first elastic arm 33*a*, the base 31, the second elastic arm 33*b*, the second contact portion 34*b* and the matching assembly 300, and a second conductive path is formed via the mating assembly 200, the first contact portion 34*a*, the first abutting portion 3511*a*, the electrical conductor 2, the second abutting portion 3511*b*, the second contact portion 34*b* and the matching assembly 300. The first conductive path and the second conductive path are in parallel, thus reducing the electrical impedance during the telecommunication transmission between the mating assembly 200 and the matching assembly 300, and thereby ensuring good electrical conduction and telecommunication transmission performance between the mating assembly 200 and the matching assembly 300.

In other embodiments, after the terminal 3 is firstly mounted into the accommodating hole 14 downward from top thereof, the electrical conductor 2 is then mounted into the accommodating hole 14 upward from bottom thereof. At this time, the first guide portion 3512*b* of the second extending arm 35*b* is in contact with the upper oblique portion 21, and the first guide portion 3512*b* serves as a guide to facilitate the mounting of the electrical conductor 2 into the insulating body 1.

In other embodiments, after the electrical conductor 2 is firstly mounted into the accommodating hole 14 downward from top thereof, the terminal 3 is then mounted into the accommodating hole 14 downward from top thereof. At this time, the first guide portion 3512*b* of the second extending arm 35*b* is in contact with the upper oblique portion 21, and the upper oblique portion 21 serves as a guide to facilitate the mounting of the terminal 3 into the insulating body 1.

In other embodiments, after the electrical conductor 2 is firstly mounted into the accommodating hole 14 downward from top thereof, the terminal 3 is then mounted into the accommodating hole 14 upward from bottom thereof. At this time, the first guide portion 3512*a* of the first extending arm 35*a* is in contact with the lower oblique portion 22, and the lower oblique portion 22 serves as a guide to facilitate the mounting of the terminal 3 into the insulating body 1.

Compared with the related art, the electrical connector 100 according to certain embodiments of the present invention has the following beneficial effects:

1. The terminal 3 is provided with the two elastic arms 33*a*, 33*b* formed by bending and extending from the base 31. The elastic arms 33*a*, 33*b* respectively extend to form the contact portions 34*a*, 34*b*, and the contact portions 34*a*, 34*b* respectively extend to form the extending arms 35*a*, 35*b*. The extending arms 35*a*, 35*b* are respectively provided with the first guide portions 3512*a*, 3512*b*, the second guide portions 3513*a*, 3513*b* and the abutting portions 3511*a*, 3511*b*. The first guide portions 3512*a*, 3512*b* are provided to facilitate the sequential mounting of the electrical conductor 2 and the terminal 3. The second guide portions 3513*a*, 3513*b* are provided to allow the extending arms 35*a*, 35*b* to guide the electrical conductor 2 when the contact portions 34*a*, 34*b* are applied with the force, such that the abutting portions 3511*a*, 3511*b* abut the electrical conductor 2. Moreover, the terminal 3 has multiple electrical paths from the mating assembly 200 to the matching assembly 300, which can satisfy the high frequency requirements of the terminal 3.

2. When the mating assembly 200 presses downward on the first contact portion 34*a*, and the matching assembly 300 abuts the second contact portion 34*b*, the upper oblique portion 21 and the lower oblique portion 22 of the electrical conductor 2 and the second guide portion 3513*a* of the first extending arm 35*a* and the second guide portion 3513*b* of the second extending arm 35*b* guide each other, thus facilitating movement of the first elastic arm 33*a* and the second elastic arm 33*b* without damage.

3. When the first elastic arm 33*a* is elastically deformed while the first contact portion 34*a* moves downward relative to the insulating body 1, and the second elastic arm 33*b* is elastically deformed while the second contact portion 34*b* moves upward relative to the insulating body 1, the upper end edge 353*a* and the lower end edge 353*b* are respectively arc-shaped structures, thus preventing from scratching in the process in which the upper end edge 353*a* and the lower end edge 353*b* are in contact with the electrical conductor 2.

4. The second guide portion 3513*a* of the first extending arm 35*a* and the upper oblique portion 21 have the same inclination angle, and the second guide portion 3513*b* of the second extending arm 35*b* and the lower oblique portion 22 have the same inclination angle, such that the upper oblique portion 21 and the lower oblique portion 22 of the electrical conductor 2 and the second guide portion 3513*a* of the first extending arm 35*a* and the second guide portion 3513*b* of the second extending arm 35*b* guide each other.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a mating assembly to a matching assembly, the electrical connector comprising:

an insulating body, provided with at least one accommodating hole;

at least one electrical conductor, correspondingly mounted to the at least one accommodating hole; and at least one terminal, correspondingly mounted to the at least one accommodating hole, wherein the electrical conductor and the terminal mounted to a same one of the at least one accommodating hole are separately provided, and each of the at least one terminal comprises:

a base, provided in a corresponding accommodating hole of the at least one accommodating hole; and two elastic arms, respectively formed by bending and extending from the base;

two contact portions, wherein each of the contact portions is correspondingly formed by extending from one of the two elastic arms, one of the two contact portions is exposed upward to the corresponding accommodating hole to be in contact with the mating assembly, and the other of the two contact portions is exposed downward to the corresponding accommodating hole to be in contact with the matching assembly;

two extending arms, formed by respectively and correspondingly extending from the contact portions, wherein each of the extending arms has a first side edge and a second side edge opposite to each other in a left-right direction and an end edge connecting the first side edge and the second side edge;

two abutting portions, respectively and correspondingly provided at the first side edges of the two extending arms, and configured to abut the corresponding electrical conductor, wherein the two abutting portions are located between the two contact portions in a vertical direction, and each of the abutting portions is respectively provided to be away from the second side edge of a corresponding extending arm of the extending arms in the left-right direction relative to a corresponding contact portion of the contact portions and the end edge of the corresponding extending arm;

two first guide portions, respectively and correspondingly provided at the first side edges of the two extending arms, wherein each of the two first guide portions extends between the corresponding contact portion and a corresponding abutting portion of the abutting portions; and two second guide portions, respectively and correspondingly provided at the first side edges of the two extending arms, wherein each of the two first guide portions extends between the corresponding abutting portion and the end edge of the corresponding extending arm.

2. The electrical connector according to claim 1, wherein the two abutting portions and the corresponding electrical conductor are located in front of the base.

3. The electrical connector according to claim 1, wherein the two abutting portions are aligned in the vertical direction.

4. The electrical connector according to claim 1, wherein each of the extending arms has a width gradually increasing at a portion from the corresponding contact portion to the corresponding abutting portion in the left-right direction, and a width gradually decreasing at a portion from the corresponding abutting portion to the end edge of the corresponding extending arm in the left-right direction.

5. The electrical connector according to claim 1, wherein each of the first guide portions is an arc-shaped structure.

6. The electrical connector according to claim 1, wherein each of the second guide portions is an inclined plane structure.

7. The electrical connector according to claim 1, wherein the electrical conductor has one side close to the terminal, an upper end and a lower end of the one side of the electrical conductor are respectively provided with two oblique portions respectively provided corresponding to the two abutting portions, and when the mating assembly and the matching assembly respectively and correspondingly abut the contact portions, the second guide portions are correspondingly guided by the oblique portions.

8. The electrical connector according to claim 7, wherein each of the second guide portions and a corresponding oblique portion of the oblique portions have a same inclination angle.

9. The electrical connector according to claim 1, wherein the terminal and the corresponding electrical conductor are sequentially mounted to the corresponding accommodating hole along a same direction.

10. The electrical connector according to claim 1, wherein the terminal and the corresponding electrical conductor are mounted to the corresponding accommodating hole along opposite directions.

11. The electrical connector according to claim 1, wherein the electrical conductor is located between the two contact portions of the corresponding terminal in the vertical direction.

12. The electrical connector according to claim 11, wherein when the terminal and the electrical conductor are sequentially mounted into the accommodating hole, the electrical conductor and one of the first guide portions of the terminal guide each other.

13. The electrical connector according to claim 1, wherein the second side edge of each of the extending arms is a vertical plain surface.

14. The electrical connector according to claim 1, wherein the accommodating hole has two side walls in the left-right direction and a front wall and a rear wall in a front-rear direction, a protruding block is formed by protruding from one of the side walls, and the protruding block matches with the front wall to fix the electrical conductor.

15. The electrical connector according to claim 1, wherein the insulating body is provided with an upper surface, one of the contact portions of the terminal in contact with the mating assembly protrudes out of the upper surface, a projecting portion protrudes upward from the upper surface at a lateral side of each of the at least one electrical conductor, and the electrical conductor is provided not to be higher than the corresponding projecting portion in the vertical direction.

16. The electrical connector according to claim 1, wherein the two elastic arms of the terminal are provided to be vertically symmetrical with respect to the base.

17. The electrical connector according to claim 1, wherein the end edge of each of the extending arms is an arc-shaped structure.

* * * * *